US011008695B2

(12) United States Patent
Piekarski et al.

(10) Patent No.: US 11,008,695 B2
(45) Date of Patent: May 18, 2021

(54) CONSTRUCTIVE ARRANGEMENT APPLIED TO THE AGITATOR OF A LAUNDRY WASHING MACHINE

(71) Applicant: Electrolux do Brasil S.A., Curitiba (BR)

(72) Inventors: Marcelo Piekarski, Curitiba (BR); Luiz Carlos Pazinato, Curitiba (BR); Fabiano Costi, Curitiba (BR); Oscar Luiz Madalena, Curitiba (BR); Eduardo Orthmann, Curitiba (BR); Eduardo De Menezes Lino Modesto, Curitiba (BR); Vicente Marconcin Vanhazebrouck, Curitiba (BR); Adriano Bonatto Cardozo, Curitiba (BR)

(73) Assignee: Electrolux do Brasil S.A.

( * ) Notice: Subject to any disclaimer, the term of this patent is extended or adjusted under 35 U.S.C. 154(b) by 352 days.

(21) Appl. No.: 15/959,883

(22) Filed: Apr. 23, 2018

(65) Prior Publication Data

US 2018/0313021 A1 Nov. 1, 2018

(51) Int. Cl.

| | |
|---|---|
| ***D06F 39/10*** | (2006.01) |
| ***D06F 21/06*** | (2006.01) |
| *D06F 13/02* | (2006.01) |
| *D06F 39/08* | (2006.01) |

(52) U.S. Cl.
CPC ..... *D06F 39/10* (2013.01); *D06F 21/06* (2013.01); *D06F 13/02* (2013.01); *D06F 39/083* (2013.01)

(58) Field of Classification Search
None
See application file for complete search history.

(56) References Cited

U.S. PATENT DOCUMENTS

| | | | | |
|---|---|---|---|---|
| 2,976,711 A | | 3/1961 | Smith | |
| 3,027,742 A | * | 4/1962 | Nowicki | D06F 13/00 68/18 FA |
| 4,003,225 A | * | 1/1977 | Worst | D06F 39/10 68/18 FA |
| 5,012,658 A | * | 5/1991 | Shikamori | D06F 13/02 68/12.01 |
| 5,714,939 A | * | 2/1998 | Song | D06F 39/082 340/607 |
| 2008/0216519 A1 | * | 9/2008 | Yoo | D06F 39/10 68/12.13 |

FOREIGN PATENT DOCUMENTS

JP 60111692 A 6/1985

* cited by examiner

*Primary Examiner* — Cristi J Tate-Sims
(74) *Attorney, Agent, or Firm* — RatnerPrestia

(57) ABSTRACT

A laundry washing machine agitator having a translucent area which facilitates visualization of the inner part of the agitator.

15 Claims, 3 Drawing Sheets

CONSTRUCTIVE ARRANGEMENT APPLIED TO THE AGITATOR OF A LAUNDRY WASHING MACHINE

This application claims the benefit of and priority to Brazil Patent Application No. 20 2017 008918-0, filed Apr. 27, 2017, which is incorporated by reference herein.

UTILITY MODEL FIELD

This utility model refers to an agitator for laundry washing machines. More specifically, this utility model relates to a laundry washing machine provided with an agitator which has a translucent area which facilitates visualization of the inner part of the agitator.

BACKGROUND OF THE UTILITY MODEL

Laundry washing machines are household, commercial or industrial equipment widely employed to assist in the task of cleaning garments or fabrics in general, due to their practicality and time-saving features provided to the user.

Laundry washing machines are usually provided with a main cabinet, a washing basket and an agitator placed inside the washing basket.

The agitator comprises at least one base and an elongated body placed on said base, so that an alternate rotational movement of the agitator about a turning center promotes agitation of the washing liquid and causes the garments or fabrics placed inside the washing basket to be properly cleaned.

Agitation of the washing liquid and the promoted friction on the garments causes lint to be detached from the fabric being washed. The accumulation of lint and dirt inside the washing basket necessitated the development of filters which would be able to keep the washing liquid as clean as possible and thus prevent the fabrics at the end of the wash from retaining lint on their surface, which causes annoyance to users.

The most common way of assembling the lint filter in a laundry washing machine provided with a mechanical agitator is by means of housing the filter inside said agitator. An example of a laundry washing machine having a filtration system inserted into the agitator is disclosed by the document JPS60111692. This document discloses a mechanical agitator comprising orifices in its elongated portion and mounted inside a washing basket, in the liquid entering the inner area of the agitator, passing through the filtering element, and returning to the washing basket by the lower area of the agitator.

The technique disclosed by the document JPS60111692 is widely known and used in laundry washing machines, in particular because it does not require a pump to promote the filtering of lint and debris which have been detached from the washed garments and fabrics. As an example of this, document U.S. Pat. No. 2,976,711 is concerned with an improvement to a system analogous to that proposed by the document JPS60111692.

In the systems above, the lint filter accumulates a large amount of lint and debris after a long period of use. When this large accumulation occurs, it is necessary to remove and clean the lint filter so that the filtration is not impaired.

To inspect the level of dirt contained in the filter, and to clean the filter, the user must interrupt the operation of the laundry washing machine and remove the filter from the inside of the agitator.

However, in this constructive arrangement, the filter is accommodated in an area not visible to the user, which often does not note the existence of a filter mounted inside the agitator or does not remember to perform its periodic cleaning. Since this cleaning does not occur periodically, there is a poor efficiency in filter operation and, consequently, a worsening in the washing efficiency of the laundry washing machine, resulting in clothes coming out of the wash covered with lint, causing discomfort to the user.

At this point, it is noted that the Prior Art does not provide an effective means for alerting the user to the need to perform the cleaning of the filter, or only allowing the user to continuously view the operation and the existence of the filter within the agitator, in addition to allowing the continuous monitoring of the level of dirt retained by it.

OBJECTIVES AND DESCRIPTION OF THE UTILITY MODEL

In this way, this utility model provides a constructive arrangement for a laundry washing machine which facilitates inspection of the lint filter conditions.

Furthermore, this utility model has a constructive arrangement which facilitates the use of laundry washing machines because it allows an easy visualization of the lint filter and consequently of the amount of dirt that is accumulated in said filter.

Another object of this utility model is to constantly remind the user to clean the lint filter. This is due to the fact that the lint filter is an internal component that in many cases the user forgets to remove for proper cleaning.

One or more objects of this utility model mentioned above, among others, are achieved by a constructive arrangement applied to the laundry washing machine agitator. This utility model is especially applied in a laundry washing machine comprising a washing basket which is loaded from the top and having the agitator located within the washing basket, the agitator being defined by an elongated body comprising a plurality of inlets for a flow of washing liquid. To achieve the desired effect, the agitator comprises at least one inspection opening in the elongated body, the opening being covered by a translucent layer.

The translucent layer covers the inspection openings and defines the walls of the elongated body of the agitator.

Those skilled in the art will appreciate that the inspection opening may be in any area of the agitator body, as long as it enables the filter mounted thereto to be viewed.

The constructive arrangement provided by this utility model may also be performed with a plurality of inspection openings placed along the elongated body of the agitator.

If the inspection opening in the elongated body of the agitator is unique, those skilled in the art will appreciate that it should be close to the filtering area of the lint filter so that the user can easily check the situation of said lint filter.

On the other hand, if a plurality of inspection openings is provided in the elongated body of the agitator, those skilled in the art will appreciate that it is advantageous to place the openings around the elongated body.

One intended form for the translucent layer is that it has a geometry compatible with the elongated body of the agitator. Those skilled in the art will appreciate this knowledge and will readily appreciate that geometric compatibility is concerned with the fact that the translucent layer has a compatible geometry and that it may be associated with the elongated body of the agitator without such association showing bumps or discontinuities on the external surface of the agitator. As already mentioned, the translucent layer is defined as a wall of the agitator.

For example, if the elongated body of the agitator has a substantially cylindrical shape, the translucent layer has a cylindrical geometric shape and dimensions compatible with those of the agitator body so that they may be associated with, for example, a semicircular cross section. If the elongated body of the agitator has, for example, a triangular geometric shape and the translucent areas are placed on the flat faces of the triangle, those skilled in the art would appreciate the knowledge described in this utility model to fabricate a translucent flat cover that fits the flat surfaces of the elongated body of the agitator.

A complementary and non-optional element, which improves but does not alter the operation of this utility model, is a locking area placed on the elongated body of the agitator. Such a locking area is intended to allow a better fit of the translucent cap covering the translucent area.

In order for the translucent layer to be suitably associated with the grooved areas of the agitator body, this utility model provides projections engaging the translucent layer and being compatible with the engaging areas of the elongated body.

Those skilled in the art will appreciate that it is possible to place the engaging projections on the elongated body of the agitator and the engaging areas in the translucent layer. This does not change the operation of the cover as it is only a variation of shape intended for the docking area and for the docking projection.

The association of the translucent cap to the elongated body of the agitator may also be made by bonding, by a welding process, over the injection of material or some other apparent means to those skilled in the art.

It is known that this utility model aims to improve the use of laundry washing machines and still assist the user in visualizing when the lint filter needs to be cleaned. Thus, the translucent area object of this utility model makes it possible to mitigate the risk that the lint filter will saturate and decrease the washing efficiency of the laundry washing machine.

Additional and optional elements as well as minor variations of form or details relating to some of the components described herein may be changed by those skilled in the art who will appreciate the knowledge disclosed herein. However, it is noted that such modifications are within the scope of protection defined in the appended claims.

BRIEF DESCRIPTION OF THE ILLUSTRATIONS

The objects, technical effects and advantages of this utility model will be apparent to those skilled in the art from the following detailed description which refers to the accompanying drawings, which illustrate a way of constructing the object of this utility model. These Figures are not intended to limit the intended protection, on the contrary, it is intended merely to exemplify a way of realizing the new constructive arrangement thus disclosed.

DESCRIPTION OF THE UTILITY MODEL

Again, it should be pointed out that the constructive arrangement which will be described below for the laundry washing machine agitator, object of this utility model, will be described in accordance with a particular embodiment, but not a limiting embodiment, since its embodiment may be carried out in different ways and variations and according to the application desired by the person skilled in the art.

To achieve the proposed objects, this utility model discloses a constructive arrangement applied to a laundry washing machine agitator 10. This utility model is especially applied in a laundry washing machine 100 which comprises a washing basket which is loaded from the top and which has the agitator 10, which is placed inside the washing basket. The agitator 10 is defined by an elongated body 20 and comprises at least one translucent area 22.

Figure 1:
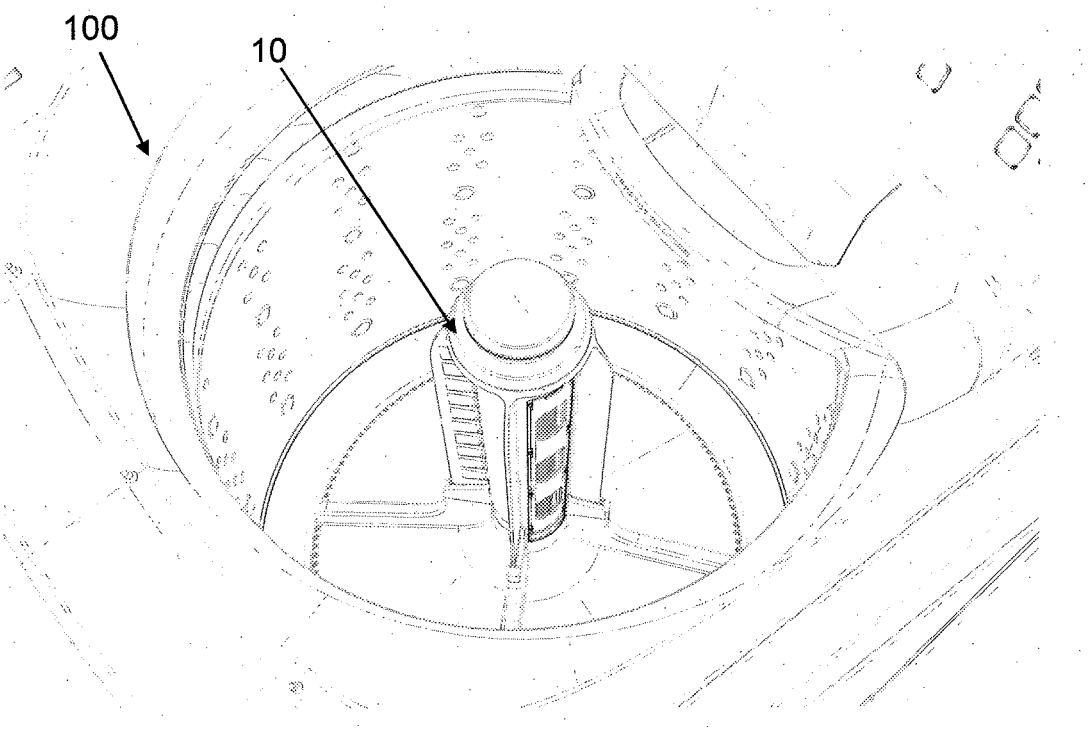
FIG. 1 shows an upper opening in a laundry washing machine with an agitator placed inside the machine.

FIG. 1 shows a top view of a laundry washing machine 100 comprising a washing basket and an agitator 10 placed inside the washing basket. As may be noted, the laundry washing machine 10 is of the type that loads from the top.

Figure 2:
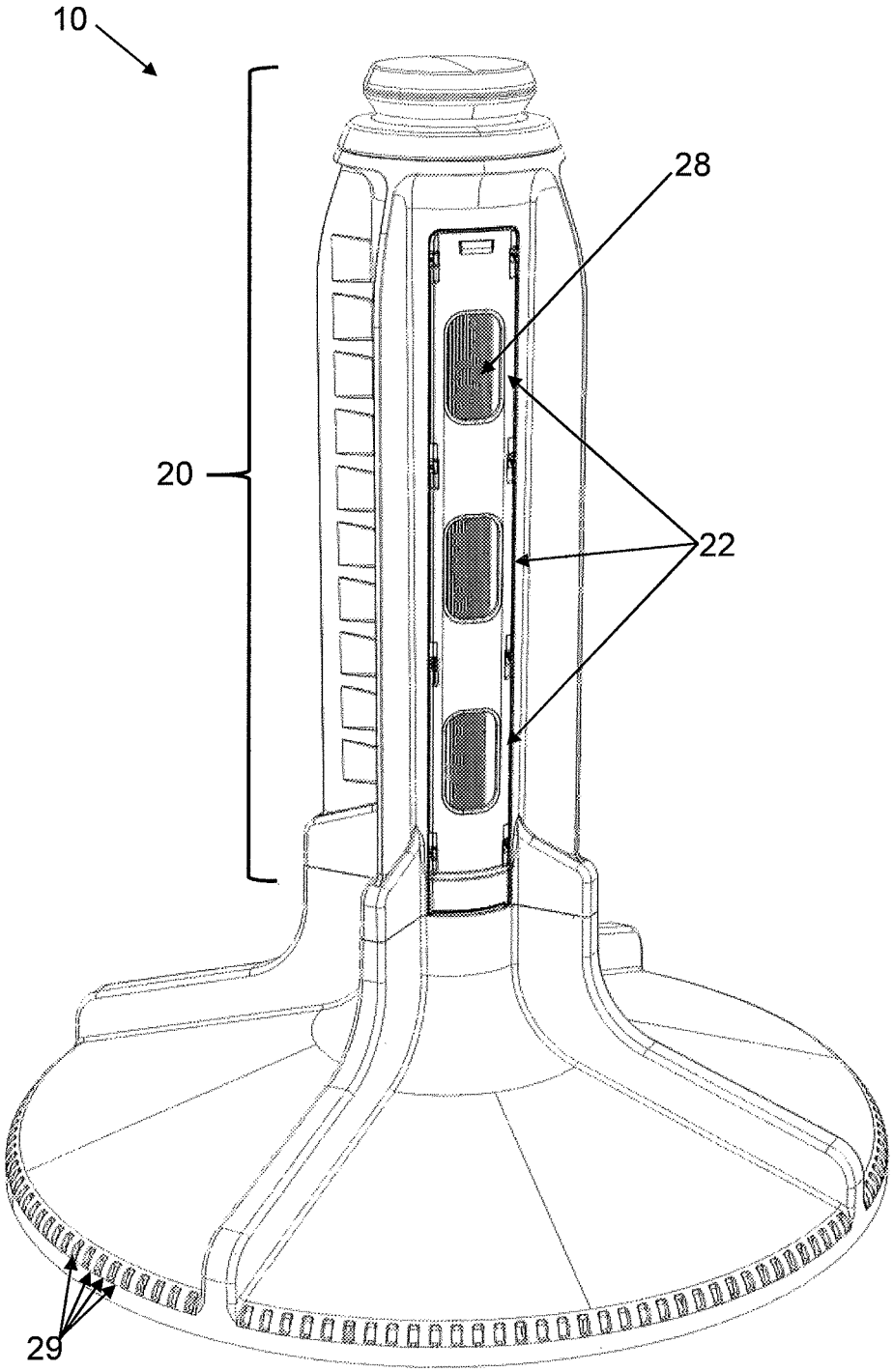
FIG. 2 shows an agitator comprising an elongated body.

FIG. 2 shows a view in perspective of the agitator 10 according to this utility model. It is possible to note the arrangement of openings 22 along the body of the agitator 20 and a lint filter 28 placed within the body of agitator 20. FIG. 2 also shows outlet holes 28 for the flow of washing liquid.

Figure 3:
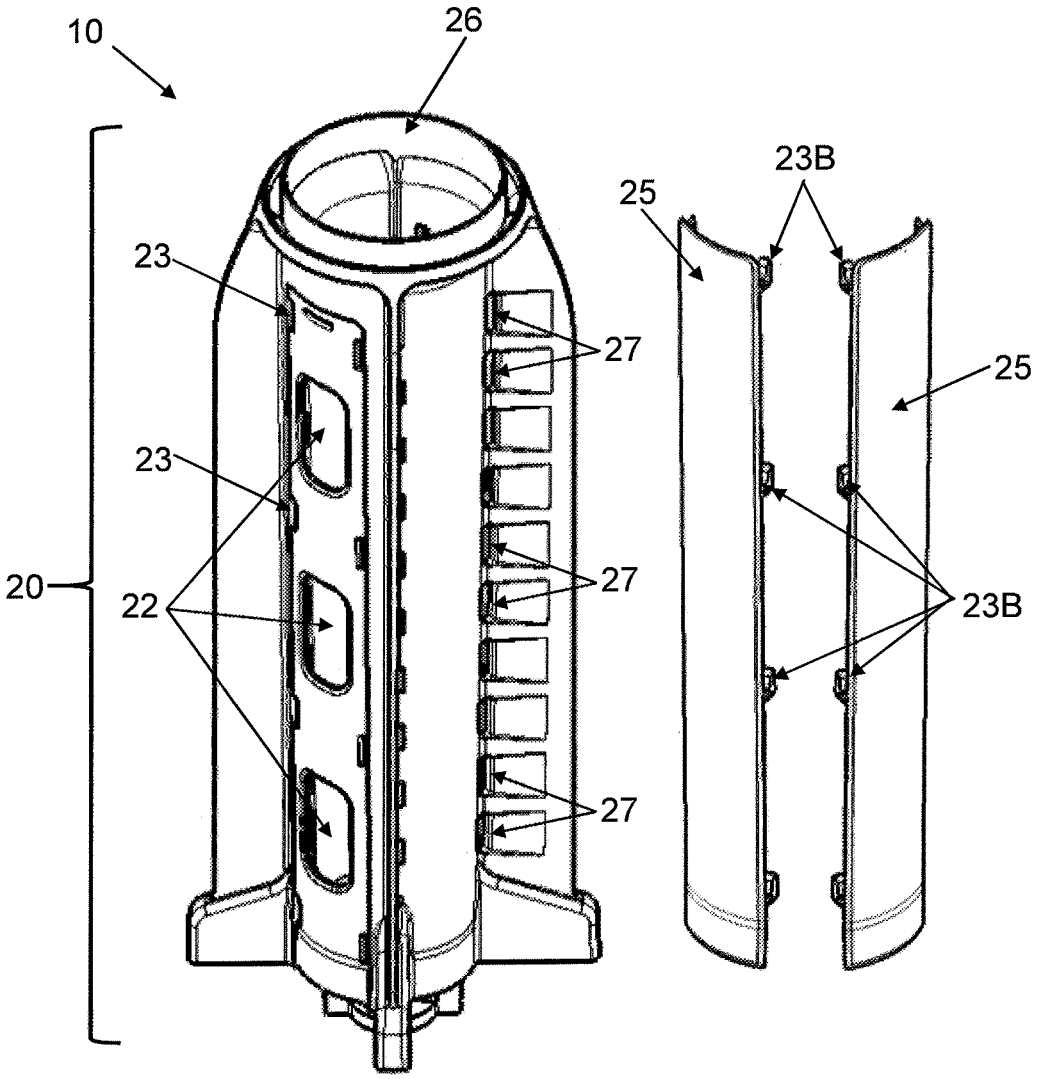
FIG. 3 shows an elongated body of a laundry washing machine agitator provided with translucent areas in an exploded view.

As can be seen in FIG. 3, the elongated body 20 of the agitator 10 comprises three inspection openings 22, said inspection openings 22 being placed along the elongated body 20 of the agitator 10.

As already described above, those skilled in the art will appreciate that if only one inspection opening 22 is used, it should be placed close to the filtering area of the lint filter 28.

FIG. 3 also makes it clear that the elongated body 20 of the agitator 10 has an upper opening 26 for insertion and removal of the lint filter 28.

As can be seen in FIG. 3, the agitator 10 of this invention has an elongated body 20 and inspection openings 22 along the length of the elongated body 20 and covered by a transparent layer 25.

Particularly, it is also possible to note in FIG. 3 that the inspection openings 22 which assist the user in checking the saturation and level of dirt trapped in the filtration element have a transparent cover 25 which prevents a flow of washing liquid from occurring through the inspection openings 22. Those skilled in the art will appreciate that the elongated body 20 may, for example, be fabricated from fully translucent material, or only with the inspection openings 22 in translucent material (by thermoplastic injection of different materials, over injection or equivalent manufacturing processes). Translucent material means any material that allows the passage of light and/or the transparency of a surface, so that it can be viewed through it.

Still, a supplementary element of optional use which can be used with the constructive arrangement proposed by this utility model, are engaging projections 23B placed in the transparent cover 25, wherein said engaging projections 23B are compatible with areas of engaging portions 23 of the elongated body 20. The transparent cover 25 may also be associated with the openings 22 of the elongated body 20 of the agitator 10 by other means. Non-limiting examples include welding processes, such as, for example, ultrasonic welding, bonding or injection.

Those skilled in the art will appreciate that the engaging projections 23B and the engaging areas 23 placed on the transparent cover 25 and the elongated body 20, respectively, have the function of associating said transparent cover 25 with the elongated body 20 of the agitator 10 in a removable manner. This facilitates a possible cleaning or exchange of the transparent cover 25, for example in the event of any cracking, blackening or breakage thereof.

This descriptive report, as well as the appended Figure, has the sole purpose of describing in detail the new provision introduced in the object of this utility model, so that the intended scope of protection should not be limited by description or drawings and the teachings herein will be appreciated and may construct variations which are within the scope of the appended Claims.

The invention claimed is:

1. An agitator for a laundry washing machine of the type comprising a washing basket loaded through an upper end thereof, the agitator being configured to be placed inside the washing basket and comprising:

an elongated body which comprises a plurality of inlet orifices configured to receive a flow of washing liquid;

at least two vanes provided along a length of the elongated body; and at least one opening along the length of the elongated body, the at least one opening being positioned between the at least two vanes and covered and closed by a transparent cover.

2. The agitator according to claim 1, wherein the at least one opening comprises a plurality of openings.

3. The agitator according to claim 2, wherein the plurality of openings are placed around a circumference of the elongated body.

4. An agitator according to claim 1, wherein the transparent cover comprises a geometric shape that fits into a corresponding geometrically shaped region of the elongated body of the agitator.

5. The agitator according to claim 1, wherein the elongated body of the agitator comprises an engaging area configured to receive the transparent cover.

6. The agitator according to claim 5, wherein the transparent cover comprises engaging projections which are compatible with the engaging area of the elongated body.

7. An agitator for a top-loading laundry washing machine, the agitator comprising:

an elongated body having an exterior surface and an interior chamber configured to receive a filter therein;

a plurality of inlet orifices passing through the exterior surface to the interior chamber and configured to pass respective flows of washing liquid therethrough;

one or more viewing openings through the exterior surface to the interior chamber adjacent a location of the filter when the filter is placed within the interior chamber of the elongated body of the agitator; and one or more transparent covers positioned over and closing the one or more viewing openings to provide a view of the filter when the filter is placed within the interior chamber of the elongated body of the agitator.

8. The agitator of claim 7, wherein the one or more viewing openings comprises a plurality of viewing openings.

9. The agitator of claim 8, wherein the plurality of viewing openings are located around the elongated body.

10. The agitator of claim 7, wherein the elongated body comprises one or more engaging areas configured to receive the one or more transparent covers.

11. The agitator of claim 10, wherein the one or more transparent covers comprise projections configured to engage the one or more engaging areas.

12. The agitator of claim 7, wherein the elongated body comprises a cylindrical body, and the one or more transparent covers extend around and match the shape of at least a portion of the cylindrical body.

13. The agitator of claim 12, wherein the agitator further comprises radial vanes extending from the cylindrical body, and the one or more transparent covers are located between an adjacent pair of radial vanes.

14. A laundry washing machine comprising:

a washing basket having an open end for loading laundry therethrough; and an agitator comprising:

an elongated body having an exterior surface and an interior chamber configured to receive a filter therein;

a plurality of inlet orifices passing through the exterior surface to the interior chamber and configured to pass respective flows of washing liquid therethrough;

one or more viewing openings through the exterior surface to the interior chamber adjacent a location of the filter when the filter is placed within the interior chamber of the elongated body of the agitator; and one or more transparent covers positioned over and closing the one or more viewing openings to provide a view of the filter when the filter is placed within the interior chamber of the elongated body of the agitator.

15. The laundry washing machine of claim 14, wherein the open end faces upwards when the washing machine is configured for use.

* * * * *